United States Patent [19]

Roberts et al.

[11] Patent Number: 4,474,281

[45] Date of Patent: Oct. 2, 1984

[54] APPARATUS AND METHOD FOR COIN DIAMETER COMPUTATION

[75] Inventors: Michael Roberts, Palatine; Gregory Slobodzian, Bartlett, both of Ill.

[73] Assignee: General Signal Corporation, Stamford, Conn.

[21] Appl. No.: 385,600

[22] Filed: Jun. 7, 1982

[51] Int. Cl.[3] ..... G07D 5/02; G07F 9/08

[52] U.S. Cl. ..... 194/1 N; 194/102

[58] Field of Search ..... 194/97 R, 99, 102, 100 A, 194/1 N; 209/908; 73/163

[56] References Cited

U.S. PATENT DOCUMENTS

| | | | |
|---|---|---|---|
| 2,903,117 | 9/1959 | Kowaleski et al. . | |
| 3,738,469 | 6/1973 | Prumm | 194/101 |
| 3,752,168 | 8/1973 | Bayha | 133/3 D |
| 3,788,440 | 1/1974 | Propice et al. | 194/99 |
| 3,797,307 | 3/1974 | Johnston | 194/100 A X |
| 3,980,168 | 9/1976 | Knight et al. | 194/100 A |
| 4,249,648 | 2/1981 | Meyer | 194/102 |

*Primary Examiner*—F. J. Bartuska

*Attorney, Agent, or Firm*—Milton E. Kleinman; John F. Ohlandt

[57] ABSTRACT

A system for recognizing coin diameters and for computing the cumulative value of coins, including an arrangement for determining the velocity of the coins under free fall conditions by measuring (1) the time taken by a given coin to traverse a fixed distance, namely, a gap between the levels at which a first and second array of detectors are disposed; further including an arrangement for measuring (2) the time between a first event when the coin reaches, for example, said first level and a second event when the coin leaves the first level, the time interval between events being representative of the diameter of the coin; and additionally including an arrangement for computing the diameter from the two time measurements.

18 Claims, 5 Drawing Figures

APPARATUS AND METHOD FOR COIN DIAMETER COMPUTATION

BACKGROUND OF THE INVENTION

1. Field of the Invention

The present invention pertains to coin recognition devices, and more particularly, to a system for determining, based on diameter measurements, whether given coins or tokens correspond with well-known denominations. The system also provides for computing the cumulative value of a series of coins taken in payment of, for example, transportation fares or tolls.

2. Background Information

A variety of devices and mechanisms for testing coins, and for orienting, sorting and feeding same, have been known in the art. In order to provide a proper context for an understanding and appreciation of the present invention, reference may be made to the following U.S. patents as background material: U.S. Pat. Nos. 2,903,117, 3,738,469, 3,752,168, 3,788,440, 3,797,307, 4,249,648.

In particular, U.S. Pat. No. 3,797,307 is regarded as being the most pertinent of the references cited above. The invention described therein relates to coin discrimination devices and, more particularly, to a system for determining the denomination of coins and for rejecting undesired coins. The principle or basis for distinguishing among differing coins is by measuring two of their physical characteristics, such as diameter and acceptance ratio, the acceptance ratio being defined as the ratio of the coin's electrical conductivity to its density. The invention therein described relies upon the effect produced on an electrically conductive nonferromagnetic coin passing through a stationary magnetic field; namely, the retardation of the initial velocity of the coin in an amount primarily dependent upon the previously noted acceptance ratio of the coin. Thus, the ultimate velocity attained by such coin, when sensed downstream of that magnetic field by the use of a pair of suitably spaced sensors, becomes a measure of the coin authenticity and denomination.

The system of U.S. Pat. No. 3,797,307 also envisions a specialized means of measuring the diameter of a moving coin by measuring the time required to pass by one of the sensors, providing a velocity-dependent measurement of the chord of the coin at the height of that sensor above an inclined coin-support track. Necessarily, because of this arrangement involving the magnetic field and the inclined track, a coin fed through such system has to be stopped at the top of the track, then released for accelerated movement responsive to the combined effects of gravity, friction and the magnetic field. As a consequence, a considerable period of time is wasted with such procedure; hence, a significant time period is consumed in determining coin diameters measured from the instant at which coins first enter the system.

Whatever the particular merits of the system of U.S. Pat. No. 3,797,307, and whatever the various details of the structural embodiments therein disclosed, the fact remains that said system presents inherent ambiguities in measurement, and is not very tolerant of vibrational or frictional effects; furthermore, it is dependent on the use of a magnetic field to affect the coin velocity, with the paradoxical result that only nonferromagnetic, electrically conductive, coins can be measured. This is because the system relies on eddy currents being induced in electrically conductive material. However, a magnetic coin would be attracted and retained by the magnet utilized for developing the primary field. Hence, a magnetic coin scavenging device would have to be installed upstream of the measurement system.

It is therefore a primary object of the present invention to provide a simplified coin measurement system that will measure or recognize coins, tokens, or other objects, whether they be made of metal, plastic or whatever material, instead, for example, of being limited to only nonferromagnetic, metallic objects.

Another primary object is to avoid ambiguities in measurement of coin diameters; that is, ambiguities inherent with measurement techniques that, if forced to contend with significantly variable velocities for different coins, could not effectively descriminate between a relatively large coin moving fast compared with a small coin moving slowly.

A further object is to make the system reasonably tolerant of vibrational or frictional effects.

Yet another object is to make the system, to a large degree, immune to various undesirable conditions, such as vibration and acceleration; moreover, to make the system capable of accurate diameter measurement regardless of the particular velocity initially or susequently assumed by the object, such as a coin, and regardless of significant variations between the velocities of different coins.

Still a further object is to enable extremely fast and accurate measurements to be made of the diameters of the objects passing through the system.

SUMMARY OF THE INVENTION

The above and other objects are fulfilled and implemented by certain primary features of the present invention. In accordance with a principal feature, the system or method enables accurate measurements of the diameters of coins or tokens or the like passing through the system. Incorporated in the system are means for effectively determining the velocity of the coins or tokens under free fall conditions; preferably both the entrance and exit velocity are determined by twice measuring the time taken to traverse a fixed distance, such distance being a gap between the levels at which a first and second array of detectors are disposed; combined therewith are two means, one for measuring the time during which the first array is occluded, and one for measuring the time during which the second array is occluded, said time intervals being representative of the entrance and exit diameters of the coin respectively; further combined are means for calculating or computing the coin diameter from the four time intervals measured.

Another principal feature resides in the further inclusion of means for comparing the measured coin diameter with respect to a large variety of valid coin diameters stored in computer memory, thereby to determine the particular coin value; and means for implementing the revenue total as the value of the coins are successively determined and validated, including means for displaying such revenue total.

In a preferred embodiment, the system includes optical devices, for example, a photo emitter array combined with a detector array; further included are plates, having a series of apertures, situated or disposed between the opposing arrays. Such arrangement serves to constrict the light path from the emitters to the respective detectors, thereby permitting a more accurate determination of the coin's position when a light beam is interrupted.

In addition to the basic emitter and detector array of the preferred embodiment already noted, which instantaneously provides input signals resulting from movement of a coin through the array, the system incorporates a microprocessor suitably programmed to compute unambiguously the diameter of a given coin by algabraically combining the measurements of first and second time intervals made as the coin passes through the array. Preferably, this is done twice and the results are averaged. A clock generator for timing purposes is connected to such microprocessor.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
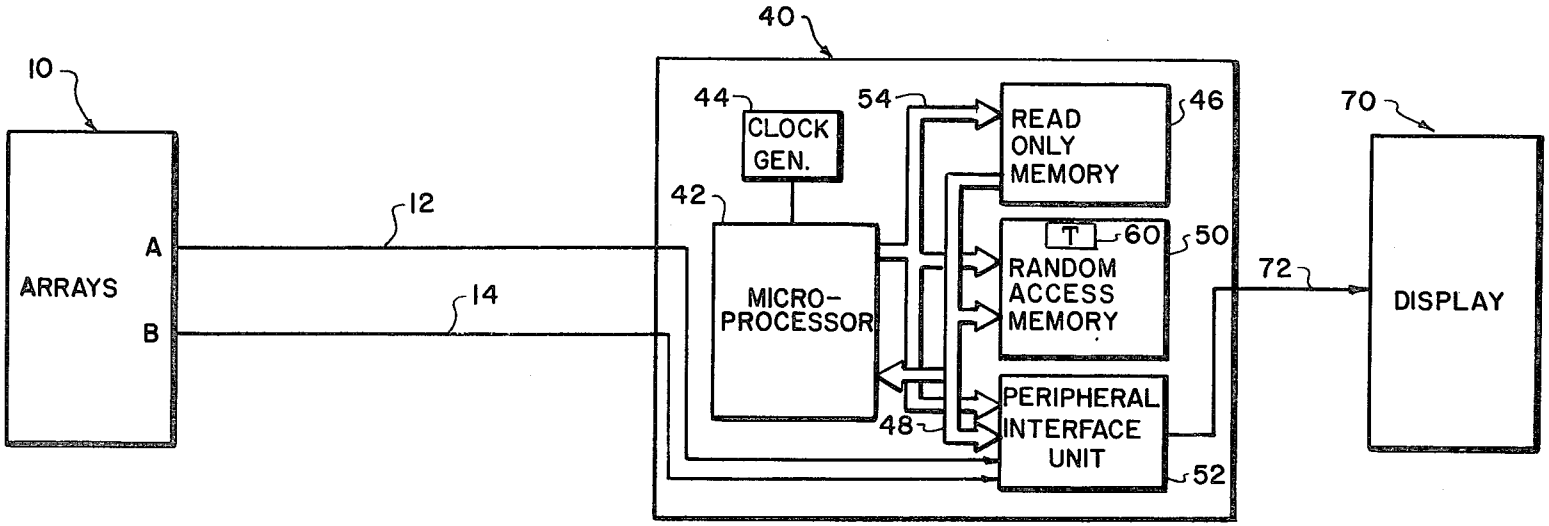
FIG. 1 is a block diagram illustrating the measurement and computation system of the present invention.

Referring now to the drawing, and particularly to FIG. 1 thereof, there is seen a block diagram depicting a complete system in accordance with the present invention. Such system comprises a pair of arrays 10, a microcomputer 40, and a display means 70. A pair of lines 12 and 14 provide communication between the pair of arrays 10 respectively designated A and B, and the microcomputer 40; the output of the microcomputer 40 communicates with the display means 70 by way of an output line 72.

It will be understood that the microcomputer 40 can comprise a microprocessor 42, for example, in the form of an integrated circuit chip known as a 6800 microprocessor, manufactured by the Motorola Corporation. This microprocessor 42 contains the logic and arithmetic circuitry for controlling the system. A clock generator 44 for timing purposes is connected to the microprocessor. Interconnection is established between the microprocessor and a read only memory 46 by a bidirectional data bus 48. The read only memory 46 (ROM) is a storage device containing the program and data for determining the actions of the microprocessor 42. The bidirectional data bus 48 also interconnects the microprocessor and a random access memory unit 50 (RAM), which is a read-write memory used by the microprocessor for temporary storage of data.

A peripheral interface unit 52 is also coupled by means of the bidirectional data bus 48 to the microprocessor 42. Such peripheral interface unit functions to allow access between the microprocessor, the several components already noted, and the several input and outputs included. Thus, the input lines 12 and 14 are connected directly to the peripheral interface unit 52, while the output of the interface unit is coupled to the display means 70 by line 72.

An address bus 54 couples the microprocessor 42 to the aforenoted components of the microcomputer so as to provide addressing information to those components: namely, to the read only memory 46, the random access memory 50; and also to the peripheral interface unit 52. This is accomplished by means well understood in the art and which for clarity have not been illustrated. However, such means are described in publications such as the "M6800 Microcomputer System Design Data" published by Motorola in 1976, which publication is incorporated herein by reference.

The address bus 54 provides three bits to an address decoder of conventional type, not illustrated, which converts those three bits to a 1-out-of-8 code for determining the particular device being accessed. The address bus 54 further provides twelve bits for selecting the particular memory element or register being accessed within the device selected by the decoder.

Figure 2:
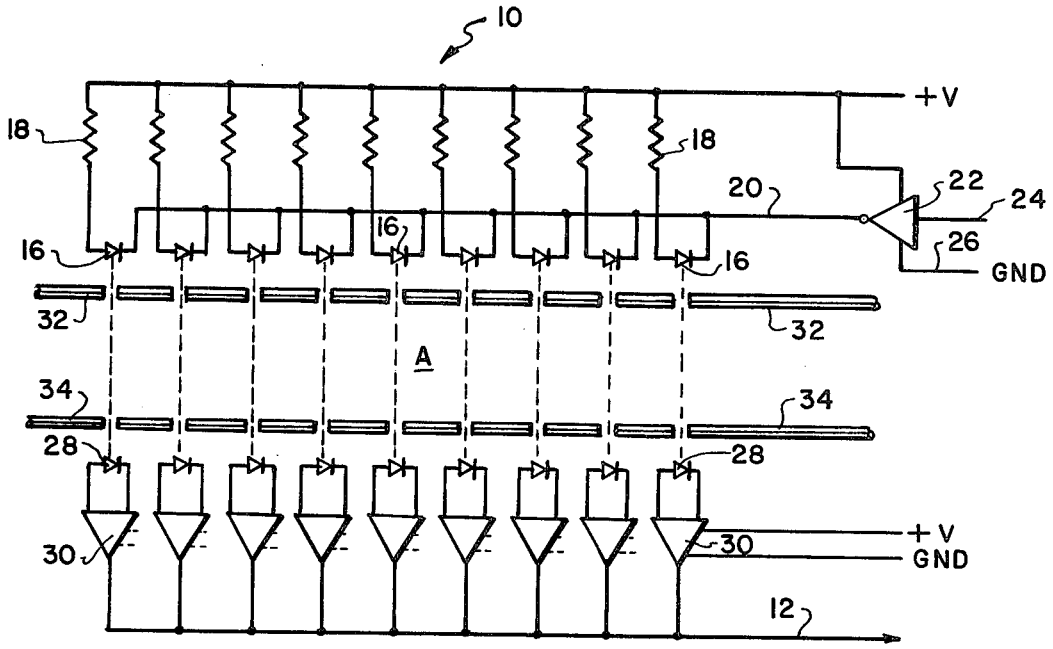
FIG. 2 is a schematic diagram which illustrates one of the LED/photodetector arrays used to determine coin diameters.

Referring now to FIG. 2, there is seen a schematic diagram of one of the pair of arrays 10, previously seen in block form in FIG. 1. The particular array illustrated is designated the A array, and an identical B array is also provided.

Figure 3:
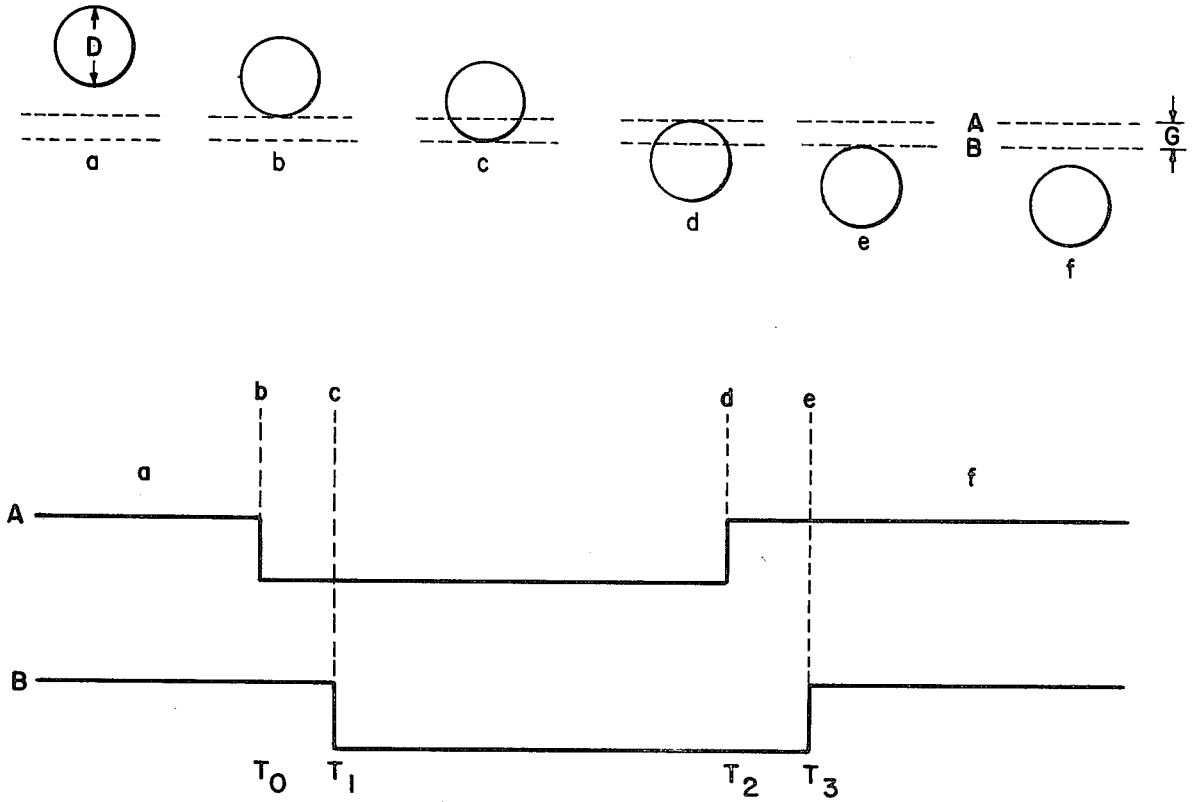
FIG. 3 is a timing diagram of a given coin moving through two arrays of the type illustrated in FIG. 2.

The particular arrangement and interconnection of these A and B arrays fulfills the principal objects of the present invention; that is, to determine the entrance and exit velocities of the coins or tokens under free fall conditions by twice measuring the time taken by a given coin to traverse a fixed distance (leading edge/trailing edge), and further to measure the time between a first occlusion, when the coin passes the first array and a second occlusion when it passes the second array. This is accomplished by having the two arrays A and B in a vertical stacked relationship, the distance therebetween being designated G (FIG. 3).

Each of the arrays A and B comprises a series of light emitting diodes 16, typically nine in number, connected to a source of voltage +V by way of respective resistors 18. The series of diodes 16 is driven by output signals on line 20, such output signals appearing at the output of a drive amplifier 22 which is provided at its input with control line 24 and a ground line 26. At appropriate times the array is turned on by means of this control line 24.

A corresponding series of photodiode detectors 28 is horizontally aligned opposite the respective light emitting diodes 16. These photodiodes are connected to the inputs of sense amplifiers 30, the outputs of which include logic devices, and are joined in common to the output line 12 previously noted. An appropriate −V voltage source is connected to each of the amplifiers 30 and likewise a ground connection is made to each amplifier (indicated by dotted lines to other than the first amplifier on the right).

A pair of apertured plates 32 and 34 is placed between the opposing arrays of LEDs 16 and photodiodes 28. This arrangement constricts the light path so that the individual light beams 36 result, thereby permitting a more accurate determination of a given coin's position when the light beam is interrupted.

It will be appreciated that with the arrangement depicted in FIG. 2, that is, with the arrangement in accordance with a preferred embodiment, a coin will travel between the pair of apertured plates 32 and 34, which serves to define a guideway, with its flat faces perpendicular to the direction of the light beams 36. Accordingly, one or more of the light beams in each of the arrays will be intercepted by the free fall of such coin. A chute not illustrated is utilized to feed the coins to the first or A array level.

Referring to FIG. 3, there is illustrated diagrammatically the two arrays A and B spaced apart by the gap G. Several events in the substantially free fall movement of a given coin, having a diameter D, are seen in FIG. 3. It will be especially noted that the events b, c, d, and e are four events of transition. The point at which the coin first interrupts a light beam 36 in the A array is the event b. Thus, the leading edge of the coin is seen to be just reaching the A array. At the event c depicted, the coin is just entering or reaching the B array, while at event d the coin is exiting or leaving the A array and further, at event e, the trailing edge is exiting the B array. Then, at f, the coin has traveled well beyond both arrays.

The output signal on the lines 12 and 14 from the arrays A and B respectively is depicted in the lower part of FIG. 3 with the same events just noted, i.e., a, b, c, d, e, and f being shown thereon. Accordingly, it will be understood that there is a relatively high level signal during event a when the coin having diameter D has not yet reached the upper array A.

Now let it be assumed that the coin has moved down such that event b takes place; that is to say, that the coin has so fallen that one of the light beams 36 in array A is intercepted by the coin. This has the result of interrupting the supply of light to a particular photodiode 28. So long as any one of these diodes has its light interrupted, a relatively low level, such as the level seen at event b, now occurs for output signal A on the line 12 from the A array (lower part of FIG. 3). Meanwhile, output signal B on line 14 from the B array continues to be at the high level. However, referring now to event c, that is, when the coin has progressed so as to interrupt a corresponding beam in the lower array B, the signal on line 14 will drop to the low level as depicted.

It will be apparent that the time interval between events b and c (first time interval) is the time it took the coin to traverse the distance of gap G. Therefore, this time is representative of the entrance velocity V, of the coin, the distance G being a constant. It will also be apparent from FIG. 3 that the time interval between events b and d (second time interval) is the time it took an object to traverse array A. From this, it will be understood that the first time interval representing the entrance velocity V, (from event b to event c), taken together with this second time interval (from event b to event d), is sufficient to determine the apparent entrance diameter D, of a given coin. Thus, the apparent entrance diameter can be computed from measurements of the first and second time intervals on a "real time" basis utilizing the microcomputer 40 already briefly described. This is accomplished by multiplying the velocity (the inverse of the first time interval) by the second time interval; or for the sake of simplicity, dividing the second time interval directly by the first time interval.

Shown on FIG. 3 are four specific time values $T_0$, $T_1$, $T_2$, and $T_3$. It will be appreciated that the time interval between events d and e, corresponding to the time it takes the trailing edge of a given coin to traverse the distance or gap G, is representative of the exit velocity of a coin passing through the system. This time interval can be divided into the interval from events c to e and thus compute the apparent exit diameter of the coin. The two measurements can thus be averaged to obtain more accurate results, one of which corrects for accelerations due to gravity.

In actual practice the averaging method yields very accurate results if the coin is permitted to free fall at least one inch before encountering the first array (A). This applies only if the coin is initially at rest. Considerably shorter distances are required if the coin has increasingly higher initial velocities. If a coin must be measured from a rest velocity with very little free fall prior to entering the measurement system then acceleration factors must be applied to yield consistent results.

Figure 4:
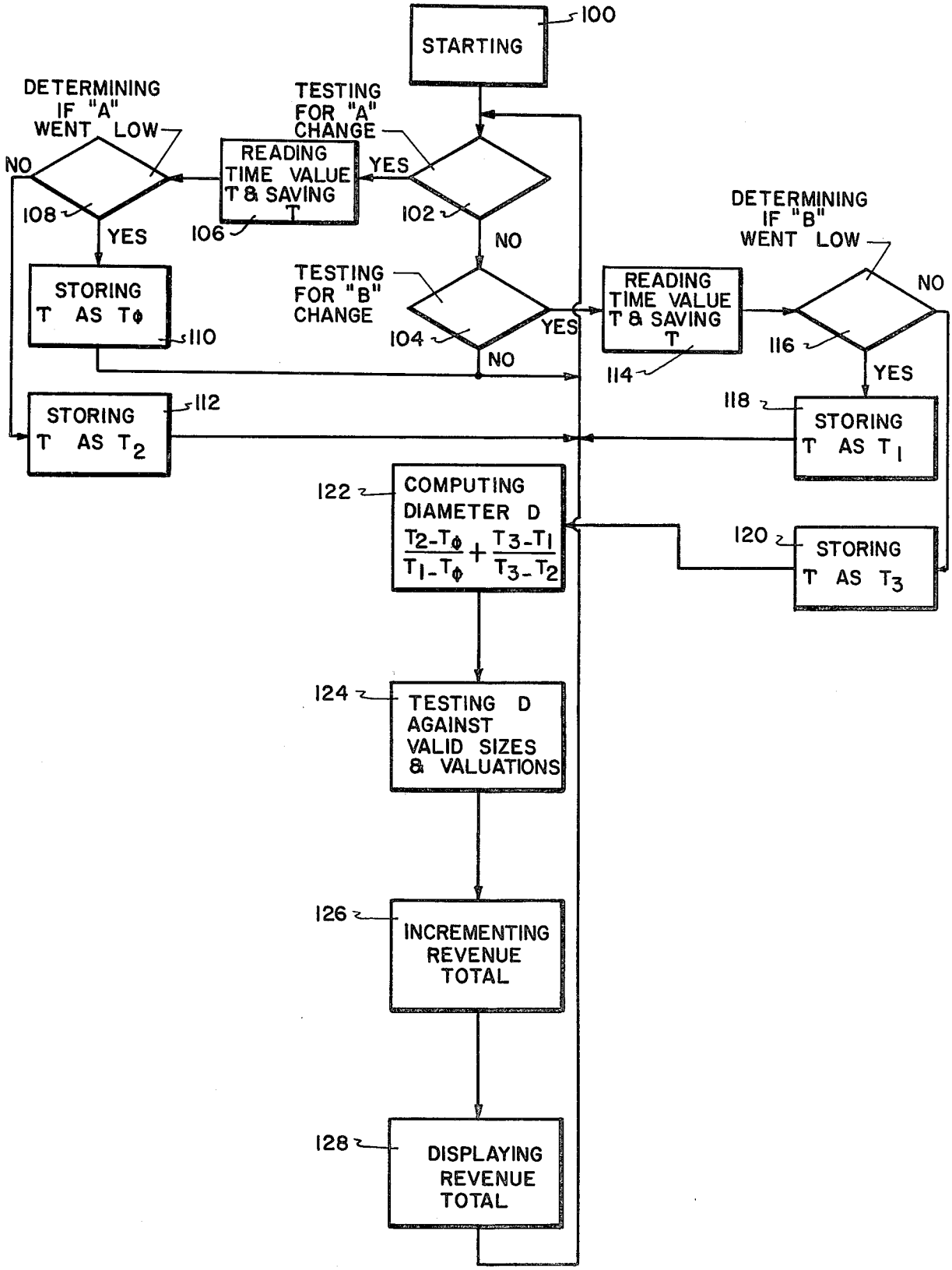
FIG. 4 is a flow chart illustrating the sequential operations performed by the system, including a microcomputer, in measuring the four time intervals involved whenever a coin is presented at the emitter/detector arrays; further, in computing the diameters of given coins from the times measured, testing the coins against valid sizes and valuations, incrementing the revenue total, and displaying same.

Referring now to FIG. 4, the operations of the system, and particularly of computer 40, are therein illustrated by a flow chart or diagram. It will be seen in this flow chart that the steps of testing the recognized diameter against valid sizes and valuations, then incrementing the revenue total, are to be performed by the computer 40, which then transmits a signal for displaying the revenue total so obtained to the display means 70 seen in FIG. 1.

Turning now to the operation of the system and in particular for the moment to the operation of microcomputer 40, this microcomputer is programmed to perform a sequence of operations, seen in FIG. 4, through conventional means forming part of such microcomputer. First, there is a conventional initial or "starting operation", designated 100, which involves loading the various program counters, table pointers and data pointers with proper values; also zeros are placed in register means 60 forming part of random access memory 50 in FIG. 1. This register means serves to store the various time values, already described, that is $T_0$, $T_1$, $T_2$ and $T_3$.

The basic input function of the microcomputer is continuously to test for any change in the input signals on the lines 12 and 14 connected from the arrays A and B respectively. Decisional or yes/no blocks 102 and 104 designate the operations to implement this function. Included as part of microcomputer 40 are comparator means for ascertaining when such a change has taken place.

It will be understood that the operation of testing for a change in the level of signal from the A array is performed first since a falling coin will initiate a change in signal first at the A array. Accordingly, the time value T at which a change in A occurs is saved in the register means 60 as indicated by the operation 106.

Now, when it has been determined by operation 108, symbolized by another decisional, or yes/no block, that the A signal went low, then the particular time value, designated $T_0$, is placed according to operation 110 at an appropriate address in random access memory 50. On the other hand, if the A signal did not go low, then it must have gone high, and in such case, the time value designated $T_2$, is set at another address in random access memory 50. This latter operation is indicated by the block 112.

Similarly, the implementation consequent to testing for a B signal change, as indicated by block 104, is achieved by the operations designated 114, 116, 118, and 120. Thus, in the event that it is determined that the B signal value went low, then a time value $T_1$ is stored, whereas in the event that the B signal went high, then the $T_3$ value is stored in an appropriate address in random access memory 50.

Having obtained all of the needed time values for computing the diameter, such operation is performed as indicated by the block designated 122. Conventional means for this purpose, forming part of the microcomputer 40, function to retrieve the required time values $T_0$, $T_1$, $T_2$ and $T_3$ from memory 50; then to compute the diameter by dividing the difference between $T_2$ and $T_0$ by the difference between $T_1$ and $T_3$, and dividing the difference between $T_3$ and $T_1$ by the difference between $T_3$ and $T_2$; then summing the results. It will be appreciated that this operation 122 provides an effective average of the two diameter measurements, since the table look-up value takes into account the fact that the indicated sum has not been divided by two. Thus, the diameter D of the coin passing through the system is definitively determined.

With the above noted size determined, that is, the size of the coin diameter, such size is tested against valid sizes and corresponding valuations; that is to say, against sizes and values stored in the table portion of read-only memory 46. This operation is designated 124 in FIG. 4. The microprocessor then increments the revenue total as indicated by operation 126 as each coin has its diameter computed in succession. Concurrently, each incremented revenue total is displayed on a typical screen or other device forming part of the display means 70, such display operation being indicated by block 128.

It will be understood that the entire series of operations depicted at FIG. 4 is accomplished in a matter of milliseconds; and that the operation is repeated over and over again so that a large group of coins can be measured very rapidly. The only requirement imposed is that a conventional arrangement be utilized to place the coins in a single file.

Figure 5:
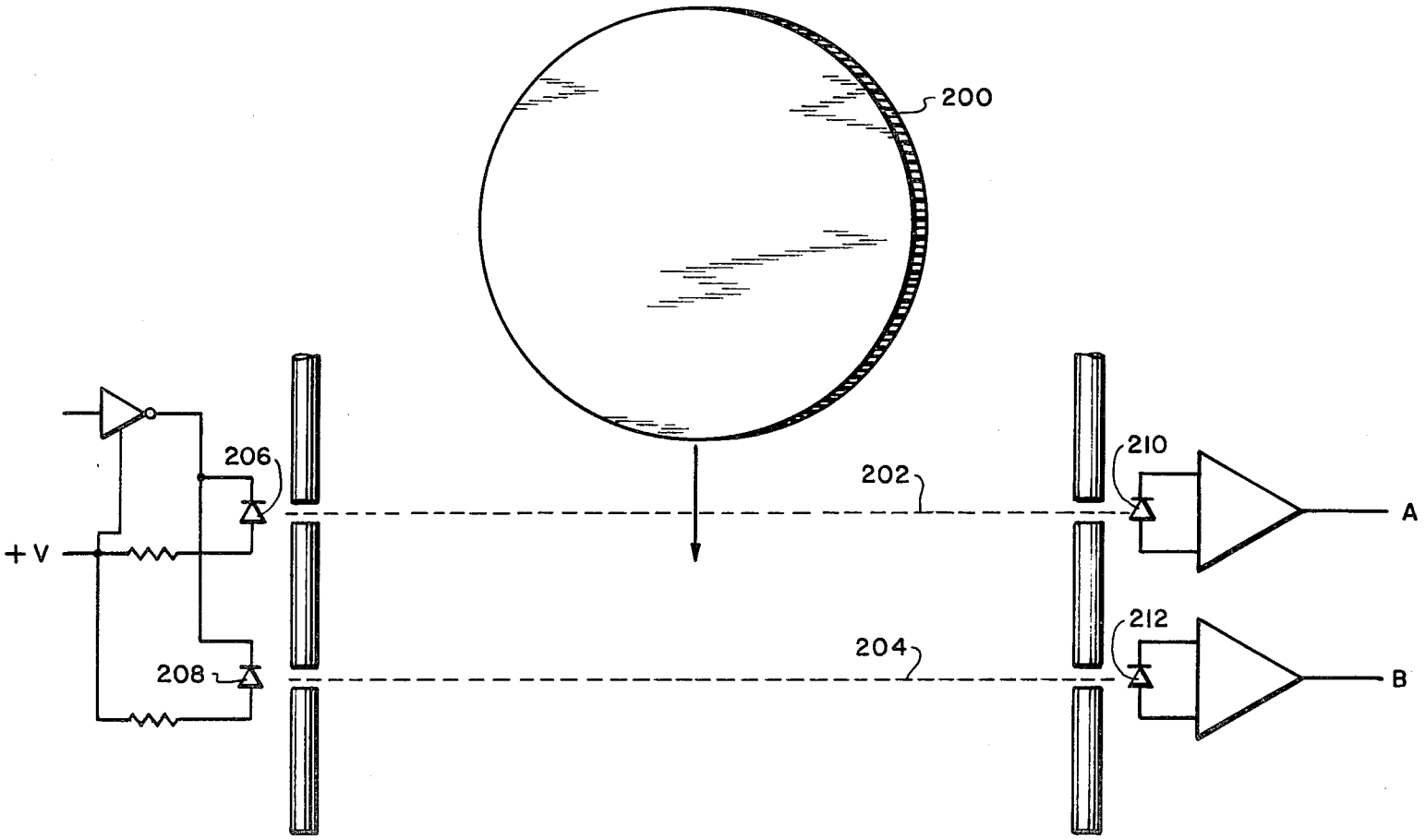
FIG. 5 is an alternate embodiment of the present invention involving a dual beam method.

Referring now to FIG. 5, there is illustrated an alternate embodiment of the array scheme for the present invention. This arrangement involves a dual beam method or system in place of the multiple beams for each of the arrays A and B previously seen in FIG. 2. Accordingly, in the configuration of FIG. 5, the coin 200 is seen to have its faces parallel with a pair of light beams 202 and 204 as the coin moves downwardly, rather than intercepting light beams perpendicular to its faces. This method has the advantage of a substantial reduction in the components required; however, an increased restriction is placed on the path which the coin may follow. It will be manifest that the same essential principle is involved in FIG. 5, namely, that the light beams 202 and 204, which are produced by respective light emitting diodes 206 and 208, function for the same purpose as those in the arrangement of FIG. 2; likewise, the photodiode detectors 210 and 212 normally receive the respective light beams but are occluded as coins or other objects pass by the arrays.

What has been disclosed is a unique system which enables extremely fast and accurate measurements to be made of the diameters of variably constituted coins and like objects passing through the system, while being substantially velocity independent and thus capable of avoiding ambiguities in measurement of such diameters. The system in essence, incorporates an arrangement for detecting the presence of coins and computing their diameters from time interval measurements which represent the velocity under free-fall conditions, and measurements of time intervals during which each of two detecting levels is passed by the coins.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. A system for recognizing the diameters of objects such as coins and the like, comprising:

means for determining the velocity of the objects, under free-fall conditions and regardless of the particular velocity initially assumed by the objects, by measuring a first time interval taken by a given object to traverse a fixed distance between two levels;

means for measuring a second time interval during which one of said levels is passed by the object; and means for unambiguously computing the diameter of the object by algebraically combining the measurements of the two time intervals.

2. A system as defined in claim 1, in which said means for computing includes means for dividing said second time interval by said first time interval.

3. A system as defined in claim 1, in which said means for determining the velocity is operative to determine both the entrance and exit velocities by twice measuring the time intervals taken by a given object to traverse said fixed distance; and in which said means for measuring is operative to measure the additional two time intervals during which each of said respective levels is passed by the object.

4. A system as defined in claim 1, in which at least one light detector is disposed at each level.

5. A system as defined in claim 4, in which at least one light emitting device is disposed at each of said levels opposite the respective detectors.

6. A system as defined in claim 2, further including a pair of arrays, each array including a plurality of light emitting diodes horizontally aligned with a corresponding plurality of photo-diode detectors;

a pair of spaced plates defining a guideway for said objects, and a series of apertures in each of the plates for normally permitting light communication between said respective light emitting devices and said detectors.

7. A system as defined in claim 1, further comprising means for testing the diameter so obtained by comparing that diameter with stored valid diameter sizes and valuations, thereby to determine authenticity.

8. A system as defined in claim 7, further comprising means for incrementing the revenue total as the value of the coins are successively determined and validated, and means for displaying said revenue total.

9. A system as defined in claim 6, further comprising means for continuously testing for a change in the first signal from said first array, means for reading the time value at which said first signal changed, and means for determining if that first signal went low or went high.

10. A system as defined in claim 9, further comprising means for storing the time value obtained as $T_0$ in the event that said first signal went low, and means for storing said time value as $T_2$ if said first signal went high.

11. A system as defined in claim 10, further comprising means for continuously testing for a change in the second signal from said second array, means for reading the time value at which said second signal changed, and means for determining if that second signal went low or went high.

12. A system as defined in claim 11, further comprising means for storing the time value obtained as $T_1$ in the event that said second signal went low, and means for storing said time value as $T_3$ if said second signal went high.

13. A system as defined in claim 12, further comprising means for computing the diameter by dividing the difference between $T_2$ and $T_0$ by the difference between $T_1$ and $T_0$, and dividing the difference between $T_3$ and $T_1$ by the difference between $T_3$ and $T_2$, then summing the results, thereby to obtain an average value of diameter.

14. A method for recognizing the diameters of objects such as coins and the like comprising the steps of:

determining the velocity of the objects, under free fall conditions and regardless of the particular velocity initially assumed by the objects, by measuring a first time interval taken by a given object to traverse a fixed distance between two levels;

measuring a second time interval between a first event when the object reaches one of said levels and a second event when the object leaves that level; and computing the diameter of the object by algebraically combining the measurements of the two time intervals.

15. A method as defined in claim 14 for recognizing the diameters of objects such as coins and the like, comprising the steps of:

computing the diameter by obtaining four time values, $T_0$, $T_1$, $T_2$, and $T_3$, representative of events in the free-fall passage of such objects, dividing the difference between $T_2$ and $T_0$ by the difference between $T_1$ and $T_0$, and dividing the difference between $T_3$ and $T_1$ by the difference between $T_3$ and $T_2$, then summing the results.

16. A method as defined in claim 14, in which said step of computing includes multiplying the first time interval by the second time interval.

17. A method as defined in claim 14, further comprising the step of testing the diameter so obtained by comparing that diameter with stored valid diameter sizes and valuations, thereby to determine authenticity.

18. A method as defined in claim 17, further comprising the steps of incrementing the revenue total as the value of the coins are successively determined and validated, and displaying said revenue total.

* * * * *